United States Patent [19]

Wesemeyer et al.

[11] 3,964,461

[45] June 22, 1976

[54] CAPACITOR TYPE MAGNETO IGNITION SYSTEM WITH DIODE-PROTECTED SHUTDOWN SWITCH

[75] Inventors: Jürgen Wesemeyer, Nurnberg-Reichelsdorf; Hans Schrumpf, Oberasbach; Werner Meier, Schwabach; Georg Haubner, Berg, all of Germany

[73] Assignee: Robert Bosch G.m.b.H., Stuttgart, Germany

[22] Filed: Nov. 26, 1974

[21] Appl. No.: 527,501

[30] Foreign Application Priority Data

Dec. 15, 1973 Germany ..... 2362472

[52] U.S. Cl. ..... 123/198 DC; 123/148 CC

[51] Int. Cl.[2] ..... F02P 1/00; F02P 9/00

[58] Field of Search ..... 123/148 CC, 198 DC

[56] References Cited

UNITED STATES PATENTS

| | | | |
|---|---|---|---|
| 3,741,185 | 6/1973 | Swift et al. | 123/148 CC |
| 3,824,976 | 7/1974 | Katsumata | 123/148 CC |
| 3,885,542 | 5/1975 | Haubner | 123/148 CC |

*Primary Examiner*—Charles J. Myhre
*Assistant Examiner*—Ronald B. Cox
*Attorney, Agent, or Firm*—William R. Woodward

[57] ABSTRACT

An additional diode is provided in series with the charging diode through which the storage capacitor of a magneto ignition system is charged and the shutdown switch for the engine is connected between the common connection of the two diodes and the common connection of the magneto generator, and the capacitor diodes, because of their high back resistance, prevent any high positive or negative voltages from appearing across an open shutdown switch.

1 Claim, 2 Drawing Figures

CAPACITOR TYPE MAGNETO IGNITION SYSTEM WITH DIODE-PROTECTED SHUTDOWN SWITCH

This invention relates to a magneto ignition system for an internal combustion engine having an improved shutdown switch arrangement, and more particularly to the type of magneto ignition system in which a capacitor is arranged to be charged through a charging diode by a magneto generator and to be discharged through an ignition coil by a controllable switching element under control of ignition timing means.

In such ignition systems a shutdown switch in some fashion bridges and the charging circuit and it is necessary, in order to shut down the engine, to close the shutdown switch in order to prevent the charging of the capacitor by the magneto generator and thus assure that the ignition is put out of operation.

It is known in such an ignition circuit to put the shutdown switch in parallel with the charging capacitor. That arrangement has the disadvantage of presenting a certain shock hazard, because the charging capacitor is charged to several hundred volts. A further disadvantage is that when the shutdown switch is much exposed to dirt, a more or less high resistance shunt circuit is provided in shunt with the ignition capacitor which reduces to some extent the capacitor charge up to the moment of ignition, particularly at the lower speed range of the engine, which leads to a great reduction of the ignition voltage at the sparkplug. In other known ignition systems of the kind here under discussion, the shutdown switch directly bridges the charging winding of the magneto generator. Since in this arrangement the negative voltage halfwave of the magneto generator is blocked by the charging diode, this leads to the application of a very high idling voltage to an open shutdown switch, which under certain circumstances may injure the person who actuates the shutdown switch.

An object of the present invention is to arrange the shutdown switch in magneto ignition systems of the capacitor type in such a way that there is no risk of excessive voltages on the switch or discharge of the ignition capacitor through a leakage circuit of the switch.

SUBJECT MATTER OF THE PRESENT INVENTION

Briefly, an additional diode is provided in series with the charging diode and the shutdown switch is connected between the common connection of these two diodes and the common connection of the magneto generator and the charging capacitor. The additional diode is, of course, poled in the same direction as the charging diode, since the capacitor is charged through both diodes.

Figure 1:
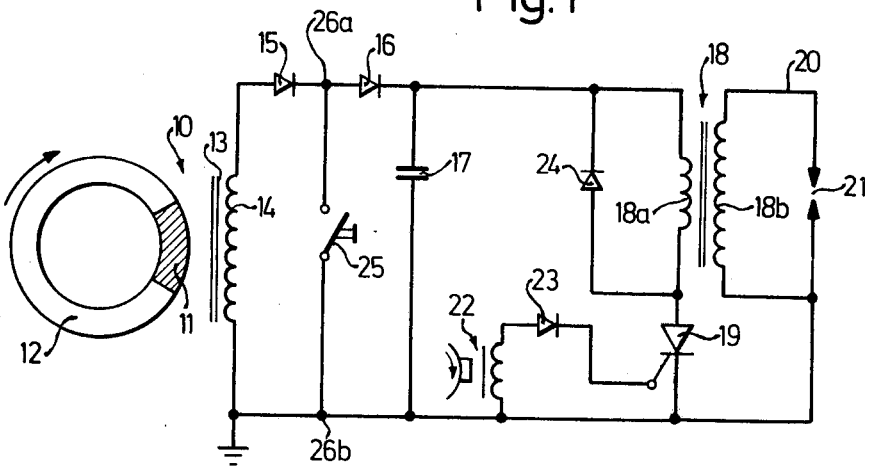
Figure 2:
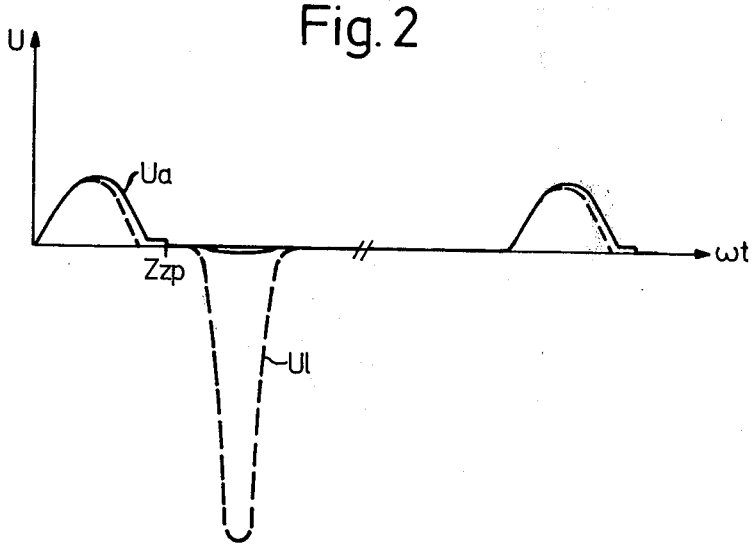

The invention is further described by way of example by reference to the accompanying drawing, in which:

FIG. 1 is a circuit diagram of a capacitor ignition system powered by a magneto generator and embodying the invention, and FIG. 2 is a graph showing the time course of voltages at the shutdown switch and at the magneto generator.

FIG. 1 shows the circuit of a capacitor ignition system powered by a magneto generator 10 having a permanent magnet 11 set into a flywheel 12 driven by an internal combustion engine (not shown). The permanent magnet 11 is moved in the direction of the arrow past the iron core 13 of a charging winding 14 of the magneto generator 10 when the flywheel 12 rotates. A voltage is thereby induced in the charging winding 14. The charging winding 14 is grounded at one end to the chassis of the engine and its other end is connected through a charging diode 15 and an additional diode 16 in series therewith to one terminal of the ignition capacitor 17. The discharge current circuit for the ignition capacitor 17, which is connected in parallel to the capacitor, includes the primary winding 18*a* of an ignition transformer 18 and the switching path of a semiconductor controlled rectifier (thyristor) 19 in series therewith. The cathode terminal of the semiconductor controlled rectifier 19 is also grounded to the chassis. The ignition transformer 18 has a secondary winding 18*b* grounded at one end to the chassis and connected at the other end over an ignition cable 20 with a sparkplug 21, which also has a ground connection to its other electrode. To provide for switching on the SCR 19 at the moment of ignition, there is provided a magnetic timing pulse generator 22 connected through a diode 23 to the control electrode 19*a* of the SCR. Still another diode 24 is connected in parallel to the primary winding 18*a* of the ignition transformer, this last diode being so poled as to be non-conducting for the discharge current of the ignition capacitor 17.

A shutdown switch 25 is provided to shut down the engine when it is running. This switch has one terminal connected to the common connection 26*a* of the diodes 15 and 16 and its other terminal connected to the common connection 26*b* of the ignition capacitor 17 and the charging winding 14 of the magneto generator 10.

The operation of the ignition system shown in FIG. 1 is best understood with reference to the voltage values shown graphically in FIG. 2. Time $\omega t$ is plotted along the horizontal axis and voltage U along the vertical axis. The solid curve shows the time course of the voltage U*a* across the shutdown switch 25 and the dashed curve shows the time course of the voltage Ul across the charging winding 14 of the magneto generator 10. When the engine is running, alternately positive and negative voltage halfwaves are induced. The positive halfwaves of the charging voltage Ul reach the capacitor 17 over the diodes 15 and 16 and charge the capacitor to their peak value. This charge remains on the capacitor 17 until the moment of ignition Z*zp*. Since at that moment the positive charging halfwave of the charging voltage Ul has dropped off or disappeared, the two diodes 15 and 16 must block the entire charge voltage of the capacitor 17. Since the back resistance of the diodes 15 and 16, at around 100 megohms is greater by one or two powers of ten than the resistance of the open shutdown switch 25, the voltage of the ignition capacitor 17 appears almost completely across the diode 16, so that the shutdown switch 25 has practically no voltage worth mentioning across it. At the moment of ignition Z*zp*, the SCR 19 is put into its conducting condition by a control pulse from the timing pulse generator 22 and the capacitor 17 discharges suddenly across the primary winding 18*a* and the SCR 19. In consequence, a high voltage pulse is generated in the secondary winding 18*b* which is supplied to the sparkplug 21 to produce an ignition spark.

When a negative halfwave of the charging voltage Ul is present, both the diodes 15 and 16 are stressed in their blocking direction. Since the charging winding 14 is not loaded during the negative voltage halfwave, the peak voltage is substantially higher than that of the positive voltage halfwave. During this negative voltage halfwave, however, practically no voltage worth mentioning is present across the shutdown switch 25, because in this case the voltage appears almost fully across the diode 15.

In the event of a leakage shunt across the shutdown switch 25, the ratio of the resistances of the diodes 15 and 16 to that of the shutdown switch 25, and hence the ratio of the corresponding voltage drops, would become still more favorable and the already very small voltage across the shutdown switch 25 would be further reduced and become practically zero. Furthermore, any leakage of the charge stored in the capacitor 17 through such a shunt at the shutdown switch 25 would be effectively suppressed by the diode 16 acting in its blocking direction. Impairment of the ignition voltage by the shutdown switch is thus no longer possible in this ignition system.

We claim:

1. In a magneto ignition system for an internal combustion engine comprising a capacitor (17) arranged to be charged in a half-wave rectifier circuit through a charging diode (15) by a magneto generator (10) having an armature winding connected to said circuit, a controllable switching element (19) under control of ignition timing means (22) arranged for discharging said capacitor at the timed ignition moment through a transformer (18) that feeds at least one sparkplug (21) and also a shutdown switch (25) bridging the capacitor charging circuit, the improvement constituted by the provision of an additional diode (16) in series with said charging diode (15), said charging diode being a diode element of a half-wave rectifier circuit which is the only rectification circuit with said armature winding of said magneto generator, and the connection of said shutdown switch (25) between the common connection (**26*a*) of said diodes and the connection (26*b***) of said magneto generator remote from said generator.

* * * * *